US006837493B1

(12) United States Patent
Cotton et al.

(10) Patent No.: US 6,837,493 B1
(45) Date of Patent: Jan. 4, 2005

(54) MOUNTAIN AND CAVE ROLE PLAYING GAME

(76) Inventors: Kenneth Cotton, 40-15 12th St., #4B, Long Island, NY (US) 11101; Fred Cotton, 40-15 12th St., #4B, Long Island, NY (US) 11101

( * ) Notice: Subject to any disclaimer, the term of this patent is extended or adjusted under 35 U.S.C. 154(b) by 0 days.

(21) Appl. No.: 10/426,353

(22) Filed: Apr. 18, 2003

Related U.S. Application Data

(60) Provisional application No. 60/374,407, filed on Apr. 22, 2002.

(51) Int. Cl.[7] ..... A63F 3/00

(52) U.S. Cl. ..... 273/254; 273/242; 273/284

(58) Field of Search ..... 273/236, 241, 273/242, 254, 284, 244, 259, 277, 260, 1.482, 309

(56) References Cited

U.S. PATENT DOCUMENTS 4,333,655 A * 6/1982 Rudell et al. ..... 273/241

5,129,655 A * 7/1992 Gillespie et al. ..... 273/241

* cited by examiner

*Primary Examiner*—Vishu K. Mendiratta

(74) *Attorney, Agent, or Firm*—Goldstein Law Offices, P.C

(57) ABSTRACT

A mountain and cave game, using a game board which depicts both a cave and a mountain, played by two teams who can either explore the cave or climb the mountain with the goal of exiting the cave or reaching the top of the mountain. Each team has a team marker which is moved along the spaces of paths toward the goal. Obstacle, helper, guide, and hope playing cards are provided in various decks. The teams alternate play, wherein obtaining one of the various obstacle cards can prevent a team from moving during their turn. Obtaining a helper card specifically matched to the specific obstacle can overcome that obstacle to allow the team to resume movement. Hope cards can overcome any obstacle but can be used a limited number of times. Guide cards allow movement of the team during their turn through the cave or mountain path.

8 Claims, 1 Drawing Sheet

MOUNTAIN AND CAVE ROLE PLAYING GAME

CROSS REFERENCES AND RELATED SUBJECT MATTER

The invention claims the benefit of provisional patent application Ser. No. 60/374,407, filed in the United States Patent Office on Apr. 22, 2002.

BACKGROUND OF THE INVENTION

The invention relates to a role playing game. More particularly, the invention relates to a game played by two teams, wherein each of two teams can attempt to scale a mountain or explore a cave. The winner is the first team to exit the cave or reach the top of the mountain.

Traditional board games provide limited obstacles to the players, and provide limited choices to the player. Very often, the game is largely determined by chance. As such, traditional board games can quickly become boring.

Adventure games allow the players to choose, and often even design, fictional characters who have various characteristics which help them meet various challenges during game play. Many adventure games proceed without a game board, but with a sophisticated system of discussion and record keeping among the players.

Certain hybrid, adventure/board games have been devised. While these units may be suitable for the particular purpose employed, or for general use, they would not be as suitable for the purposes of the present invention as disclosed hereafter.

SUMMARY OF THE INVENTION

It is an object of the invention to produce a game which remains interesting to the players, even after it is played several times. Accordingly, the game allows the players to choose between two very different paths at the beginning of the game—that is they may choose to explore the cave with the goal of finding an exit, or to scale the mountain with the goal of reaching the summit.

It is a further object of the invention that the obstacles that each team encounters will vary significantly from game to game. Accordingly, the game contemplates the usage of numerous obstacle cards, which are each contextually applied to either the mountain scaling or cave exploration.

It is a still further object of the invention that the obstacles encountered may be overcome by the skillful play by the team which encounters the obstacle. Accordingly, helper cards are provided which can be used to counter the obstacle if they are appropriately applied to the correct obstacle by the user. According to a further embodiment of the game, the helper cards can be electronically matched to the obstacles, so that the obstacle "lights up", when the proper helper card is applied thereto.

It is yet a further object of the invention to provide a game which is detailed yet flexible. Accordingly, a double-sided game board may be employed whereby one side depicts the cave and the other side the mountain. According to such an embodiment both teams explore the cave or climb the mountain, and only that side of the game board is used during game play.

The invention is a mountain and cave game, using a game board which depicts both a cave and a mountain, played by two teams who can either explore the cave or climb the mountain with the goal of exiting the cave or reaching the top of the mountain. Each team has a team marker which is moved along the spaces of paths toward the goal. Obstacle, helper, guide, and hope playing cards are provided in various decks. The teams alternate play, wherein obtaining one of the various obstacle cards can prevent a team from moving during their turn. Obtaining a helper card specifically matched to the specific obstacle can overcome that obstacle to allow the team to resume movement. Hope cards can overcome any obstacle but can be used a limited number of times. Guide cards allow movement of the team during their turn through the cave or mountain path.

To the accomplishment of the above and related objects the invention may be embodied in the form illustrated in the accompanying drawings. Attention is called to the fact, however, that the drawings are illustrative only variations are contemplated as being part of the invention, limited only by the scope of the claims.

BRIEF DESCRIPTION OF THE DRAWINGS

In the drawings, like elements are depicted by like reference numerals. The drawings are briefly described as follows.

Figure 1:
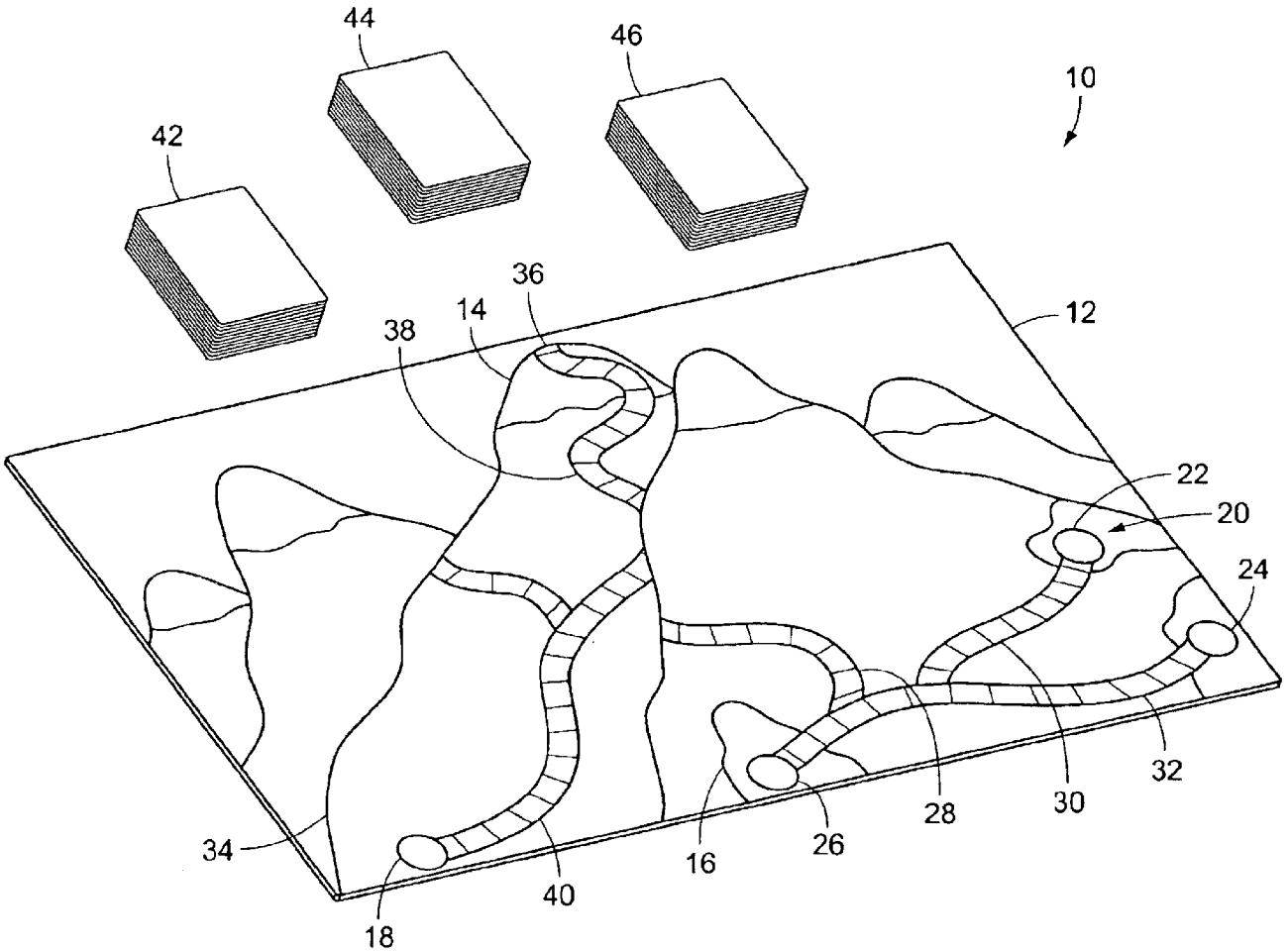
FIG. 1 is a diagrammatic perspective view of a game board and three decks of cards according to the present invention.

Herein is described a game 10 which may be referred to as "mountains and caves", the game so called because it provides players with a choice of two possible game scenarios: one of exploring a cave and another of scaling a mountain. A game board is provided which depicts a cave and a mountain. Numerous variations are possible for such a game board as would be appreciated by those skilled in the art. In particular, as shown in FIG. 1, the game board 12 depicts a cave 20 and a mountain 14. The game board 12 further depicts a base camp 18 and 26 which is a location on the game board designated space which is a starting point for each of the teams. The cave 20 has at least one entrance 16, an exit 22 and 24 and multiple areas and paths 28, 30 and 32 between the entrance and exit. The mountain 14 has a mountain base 34 and a mountain top 36, and paths 38 and 40 having multiple locations and sub paths between the mountain base 34 and mountain top 36. In general, within the cave 20 and upon the mountain 14, multiple paths are provided each having multiple spaces which are adjacent to other such spaces. During ordinary play, players can choose a desired adjacent space and move to the desired adjacent space. The game is played by at least two teams of preferably four to six players. Each team has a team leader who ultimately takes action on behalf of the team, and a team marker which physically marks the space occupied by that team.

Game play can be initiated by the team who obtains a higher score on the spinner, a die, or the like. According, the team selected to have the first turn is the starting team. The starting team can choose their quest of either exploring the caves or the climbing the mountain. According to various embodiments of the game, either the second team then follows the choice made by the previous team; follows the opposite choice as the previous team; or can also choose either to explore the caves or climb the mountain. According to a further embodiment of the game, a two-sided game board is provided such that the cave is depicted on one side, and the mountain is depicted on the other side. According to that embodiment, both teams must follow the same quest.

Essential components of the game are obstacles and helpers. The obstacles are preferably provided in an obstacle card deck of fifty (50) cards. However, as less than fifty distinct obstacles are provided within the game, many obstacles are repeated within the deck. Each distinct obstacle is associated with either the mountain journey or the cave journey. Accordingly, the obstacles may be provided in separate decks 42 and 44 for either cave exploring or mountain climbing, or can be combined wherein each card has a different meaning depending on whether the team who draws the card is exploring the cave or climbing the mountain. In particular, the prospective mountain obstacles are:

1. FURY: Presents super powerful winds which prevent the team from climbing the mountain.
2. FREEZE: Capable of freezing everything in sight.
3. AVALANCHE: Creates engulfing snow slides
4. STORM: Creates endless rain, sleet, and snow, when in combination with fury it creates an extremely formidable obstacle.

The prospective cave obstacles are:

1. RUMBLE: creates interior rock slides.
2. VIBRATOR: creates powerful vibrations, can work in tandem with rumble.
3. ROCKS: has the ability to close off exits and do harm to the explorers by raining down rocks of all sizes.
4. WAVE: ability to create interior tidal waves near any source of water.
5. PIT: powerful fiery eruption. Can be deadly to explorers
6. DARKNESS: creates pitch blackness—the team cannot maneuver in darkness.
7. FEAR: takes away the confidence of the cave explorers, making them unable to move forward.

As previously stated, the obstacles prevent a team from proceeding toward their goal, unless and until that obstacle is overcome. The helpers are used to neutralize or overcome the obstacles. However, each helper is uniquely associated with a particular obstacle. Accordingly, the helper must be properly applied to the appropriate obstacle in order to be effective.

The helpers are provided in a helper card deck 46 of twenty four (24) cards. Accordingly, many of the helpers are repeated within the deck 46. As the helpers are uniquely matched to the obstacles, it is important that they be repeated to give each team the chance of encountering the appropriate obstacle. Conceptually, the helpers overcome the obstacles by erecting bridges, creating shields, stopping rumbles inside the caves, stopping avalanches, illuminating darkness, calming bad weather, etc. According to an embodiment of the invention, the helper cards can be electronically matched with the obstacles, so that properly matched helper and obstacle cards will illuminate when placed together. With regard to the matching of helpers to obstacles, below is a prospective list of the foregoing obstacles and their prospective helpers:

| Obstacle | Helper |
|---|---|
| FURY | SHIELD |
| FREEZE | SUN |
| AVALANCHE | TEMPERATE |
| STORM | BUBBLE |
| RUMBLE | STEADY |
| VIBRATOR | NETS |
| ROCKS | CALM |
| PIT | FORCE |
| DARKNESS | LIGHT |
| WAVE | SERENE |
| FEAR | COOL |

It should be understood that the foregoing list of prospective obstacles and helpers is by no means comprehensive. However, the properly matched helper is necessary to overcome the obstacle and allow the team to go forward. Accordingly, once a player draws an obstacle card, they are frozen in position until they draw the proper helper card, or are otherwise prevented from traveling the path obstructed by the obstacle.

The helper card deck 46 also contains guide cards. If drawn from the helper deck 46 by the team having the current turn, the guide cards do not remove the obstacle, but allow the player to move to another space—and follow a different path.

Further, within the helper card deck 46, hope cards are also provided. The hope cards can be used to overcome any of the obstacles, and unlike the other helper cards—can be retained by a team. However, the use of the hope card may be limited to certain number of usages. Generally, the hope card is limited to three (3) usages.

In general, the helper cards may be drawn from the deck, used if appropriate during that turn, but are otherwise surrendered back into the deck. Accordingly, the teams cannot horde helper cards for future use obtaining the correct helper card when needed is then to some degree a matter of luck. But if the team is holding a hope card, they need not wait for the proper helper card. However due to the limited usages of the hope card, it must be used strategically.

Typically then, the current player turn alternates between teams. Upon each turn the playing team chooses a prospective adjacent space along one of the paths which is adjacent to their team marker, draws an obstacle card which then becomes associated with that space, which will freeze them in position until they encounter the matching helper card, or are permitted to take an alternate path. Accordingly, the team draws a card from the helper card deck. If they draw the matching helper card, they are permitted to enter that space and continue upon that path. Alternatively, if they draw a guide card, they are permitted to move to another adjacent space. Movement of the team upon the game board (either within the cave or climbing the mountain) may be dictated by the spinner, or by directions provided on the guide card. If neither the matching helper card (associated with the obstacle), nor a guide card is drawn by the team, then the team will lose a turn and play alternates to the other team.

The winning team may be chosen as the first to successfully climb the mountain and reach its peak, or to reach a cave exit. According to embodiments of the game, when reaching the cave exit, the game board can be configured to illuminate a series of dollar signs, or when reaching the mountain peak said team can be allowed to plant their flag. However, according to other embodiments of the game, points can be accumulated by collecting treasure which may be in the form of coins, overcoming obstacles, visiting certain spaces on the board, etc. In addition, according to another embodiment, the drawing of a hope card will essentially or automatically win the game for that team. According to such alternate embodiments, the winning team can be ascertained on the basis of a point system.

In conclusion, herein is presented a game which allows a pair of teams the ability to either explore a cave or climb a mountain. Each team's progress toward its goal may be frozen by encountering obstacles, resumed by using properly matched helpers, and facilitated by guides. The invention is described by example in the foregoing description. Numerous variations are possible while adhering to the inventive concept. Such variations are contemplated as being a part of the present invention.

What is claimed is:

1. A method of playing a mountain and cave game by two teams, the method using a game board having a starting point, a cave, and a mountain, the cave having a cave entrance a cave exit, and at least two path having a plurality of spaces between the cave entrance and cave exit, the mountain having a mountain base, a mountain top, and at least two paths having a plurality of spaces between the base and mountain top, the method using a team marker associated with each of the teams, an obstacle card deck and a helper card deck, the obstacle card deck having several distinct obstacle cards, the helper card deck having several distinct helper cards which are uniquely associated with the obstacle cards and having guide cards, the method comprising the steps of:

(a) positioning a marker piece representing each of the teams upon the starting space;

(b) selecting one of the teams to have the first turn, and the other of the teams to have the second turn;

(c) choosing a quest by the team selected to have the first turn to perform one of climbing the mountain and entering the cave, and positioning the marker for said team on one of the base of the mountain and the cave entrance, respectively, and setting the goal for that team as one of the mountain top and cave exit, respectively;

(d) choosing a desired adjacent space to move the team marker in one direction by the team having the current turn;

(e) drawing an obstacle card from the obstacle deck by the team having the current turn and associating that obstacle with the desired adjacent space;

(f) drawing a card from the helper deck by the team having the current turn, and said team performing one of:

(i) selectively proceeding to the desired adjacent space by moving the team marker to the desired adjacent space by overcoming the obstacle, said obstacle is overcome if the card drawn from the helper card deck is a helper card drawn associated with said obstacle, (ii) selectively proceeding to another adjacent space in another direction by the team if the card drawn from the helper deck is a guide card, and (iii) losing a turn if neither (i) nor (ii) are selected;

(g) determining the quest for the other of the teams, selected to have the second turn, by placing the marker for said other team at one of the base of the mountain and the cave entrance; and (h) determining a winning team by alternating the current turn by the teams, and repeating steps (e) through (f) between the teams until one of the teams reaches the end of their quest.

2. The method of playing a mountain and cave game as recited in claim 1, wherein the helper card deck further comprises at least one hope card, wherein the step of overcoming the obstacle further comprises overcoming the obstacle with the hope card by presenting the hope card by the team.

3. The method of playing a mountain and cave game as recited in claim 2, wherein the determining a winner further comprises determining that the winner is the first team to reach the end of their quest.

4. The method of playing a mountain and cave game as recited in claim 3, wherein the step of overcoming an obstacle if the card drawn from the helper card deck is a helper card is associated with that obstacle further comprises surrendering said helper card.

5. The method of playing a mountain and cave game as recited in claim 4, wherein the step of overcoming the obstacle with the hope card further comprises retaining the hope card until the step of overcoming the obstacle with the hope card has been performed three times by that team with that hope card.

6. The method of playing a mountain and cave game as recited in claim 5, wherein step (g) of determining the quest for the team having the second turn comprises setting said team having the second turn as the alternate of the quest chosen by the team having the first turn in step (c).

7. The method of playing a mountain and cave game as recited in claim 6, wherein distinct obstacles are associated with the quest of climbing the mountain and other distinct obstacles are associated with the quest of exploring the cave.

8. The method of playing a mountain and cave game as recited in claim 7, wherein the obstacles associated with the quest of mountain climbing and the helpers associated therewith are the obstacle of fury associated with the helper of shield, the obstacle of freeze associated with the helper of sun, the obstacle of avalanche associated with the helper of temperate, and the obstacle of storm associated with the helper of bubble.

* * * * *